United States Patent [19]

Boehland et al.

[11] Patent Number: 4,483,038

[45] Date of Patent: Nov. 20, 1984

[54] MOTORIZED CHIMNEY CLEANING APPARATUS

[75] Inventors: Burnell G. Boehland, Creswell; Donald G. Coutts, Eugene, both of Oreg.

[73] Assignee: Speedy Automatic Chimney Sweep, Inc., Eugene, Oreg.

[21] Appl. No.: 530,781

[22] Filed: Sep. 9, 1983

[51] Int. Cl.[3] ..... F23J 3/00

[52] U.S. Cl. ..... 15/249; 15/104.2; 15/163

[58] Field of Search ..... 15/246, 246.5, 249, 15/242, 243, 162, 163, 104.1 R, 104.1 C, 104.11, 104.14, 104.16, 104.2, 21 R, 21 B, 21 C

[56] References Cited

U.S. PATENT DOCUMENTS 2,195,344 3/1940 Slaugenhop ..... 15/246.5
4,210,976 7/1980 Apelt et al. ..... 15/246.5

FOREIGN PATENT DOCUMENTS 2327296 1/1975 Fed. Rep. of Germany ..... 15/163
447031 3/1968 Switzerland ..... 15/246.5

*Primary Examiner*—Peter Feldman
*Attorney, Agent, or Firm*—James D. Givnan, Jr.

[57] ABSTRACT

An apparatus including a powered brush for the periodic cleaning of a chimney or other smoke conduit. A reversible electric motor drives a brush carrying threaded shaft centrally disposed along a length of chimney conduit. Trigger means includes a toggle actuated at one limit of brush travel and alters a motor control circuit to effect reverse motor operation and hence change the direction of brush travel. The lower end of the motor driven shaft is stabilized against lateral displacement by a stationary spider within the chimney with the spider additionally serving to support the toggle and a push rod actuated by the toggle. The push rod passes through and stabilizes the brush against rotation.

12 Claims, 4 Drawing Figures

MOTORIZED CHIMNEY CLEANING APPARATUS

BACKGROUND OF THE INVENTION

The present invention pertains to apparatuses for dislodging the products of combustion from the walls of chimneys, smokestacks and the like.

In an effort to obviate periodic manual cleaning of chimney and smokestack interiors various apparatuses have been devised such as those including a brush or brushes pulled through a smoke conduit by a flexible member reeved about pulleys mounted at the conduit ends. Typically, such arrangements rely on manual effort for brush travel and require some structural modification of the smoke conduit. Examples of such prior art apparatuses are disclosed in U.S. Pat. Nos. 707,713; 1,859,166 and 4,349,989.

SUMMARY OF THE PRESENT INVENTION

The present invention is embodied in a cleaning apparatus for chimneys, smokestacks and other smoke conduits and includes a powered brush member for travel along the smoke conduit walls.

The present apparatus includes a motor driven shaft extending substantially the length of the conduit portion to be periodically cleaned. A housing offset at the upper end of the conduit houses a reversible electric motor and control means. A brush carried by the driven shaft actuates at its limits of travel motor control components to control motor direction and hence the direction of brush travel. Certain of said motor control components are supported within the chimney by the motor driven shaft and are contacted by the brush at the lower limit of its travel. Other motor control components are housed at the conduit upper end where they are shielded from excessive heat and smoke contamination. The powered shaft for the brush may be of segmented construction for ease of shipping and installation. A push rod within the chimney, or other smoke conduit, serves to stabilize the brush during its travel along the driven shaft.

Important objectives include the provision of a chimney cleaning apparatus which is automatic in its operation; the provision of a chimney cleaning apparatus wherein a powered shaft drives a stabilized brush the length of the smoke conduit and actuates a control upon reaching its lower limit of travel to reverse brush travel; the provision of a chimney cleaning apparatus which may be installed within a chimney without modification of the smoke conduit; the provision of a chimney cleaning apparatus wherein electrical components are isolated from heat and contamination.

DETAILED DESCRIPTION OF THE PREFERRED EMBODIMENT

Figures 1, 2, 3, 4:
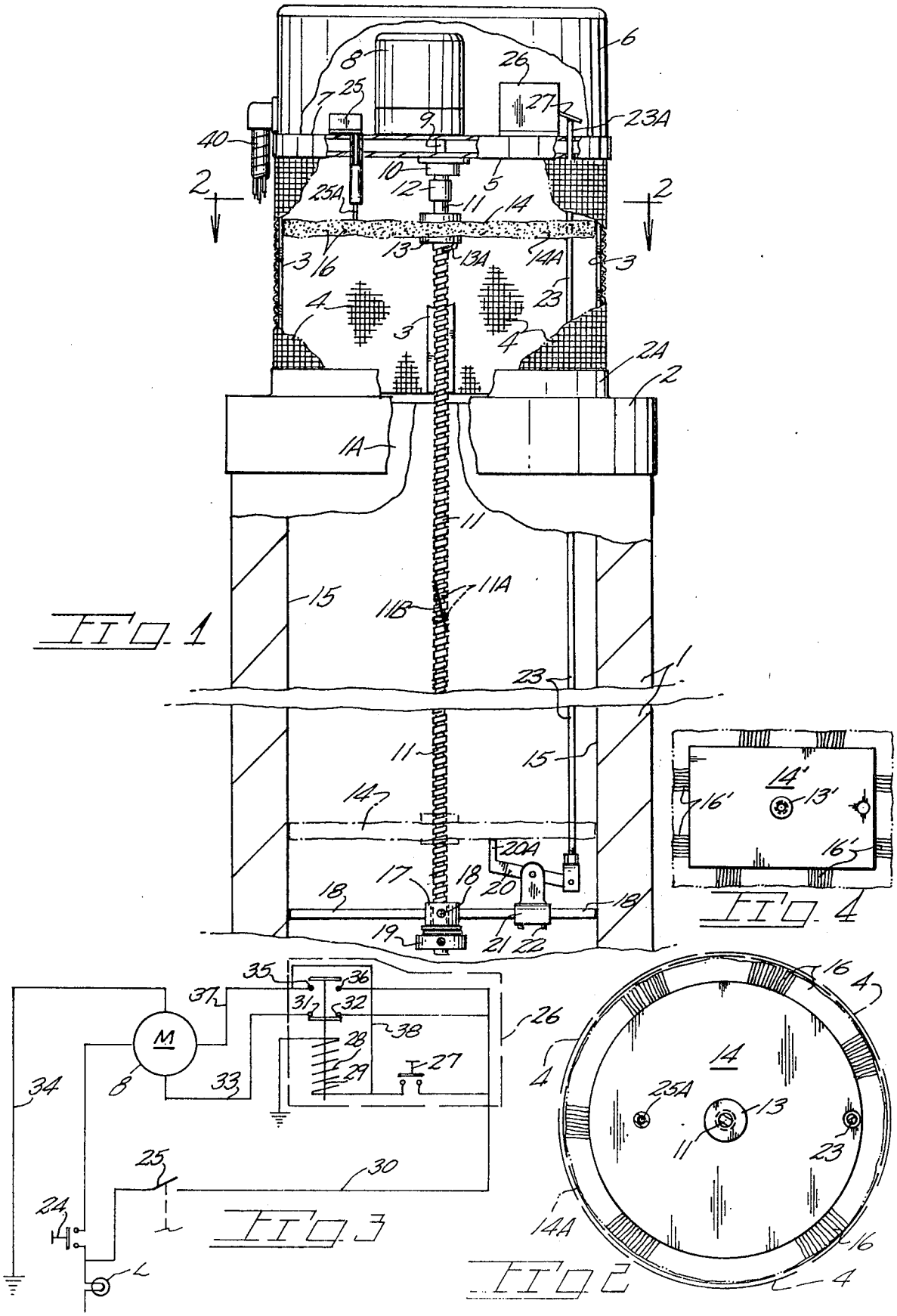
FIG. 1 is an elevational view of a smoke conduit sectioned for purposes of illustration with the present apparatus in place therewithin.
FIG. 2 is a horizontal plan view of the brush component taken along line 2—2 of FIG. 1.
FIG. 3 is an electrical schematic.
FIG. 4 is a horizontal plan view of an alternate configuration of the brush component taken along line 2—2 of FIG. 1.

With continuing attention to the drawing wherein applied reference numerals indicate parts hereinafter similarly identified, the reference numeral 1 indicates a smoke conduit which comprehends chimneys, smokestacks and all other like conduit structures through which products of combustion are discharged to the atmosphere.

A chimney cap 2 is of a size and shape to fit about the upper end 1A of the smoke conduit which will vary to accommodate a wide variety of conduit configurations and materials. A perimetrical flange 2A of the cap supports posts 3 spaced thereabout. A firescreen 4 extends upwardly from flange 2A of the cap and terminates at a housing bottom wall 5 supported by posts 3. Wall 5 is part of a motor housing 6 as is a false bottom wall 7 which serves to minimize heat transfer upwardly to the housing interior.

Supported in place on wall 7 is a D.C, gearhead motor 8 having an output shaft 9 journaled in a sealed thrust bearing 10. The output shaft 9 is coupled to a brush powering shaft 11 by a coupling at 12.

Shaft 11 is helically grooved and receives an internally threaded follower 13 in place on a brush component 14. Accordingly, the direction of shaft rotation will determine the linear direction of brush component 14 within the smoke conduit.

The brush component 14 may be a plate of circular or rectangular configuration and of a size to locate its periphery 14A adjacent the surface 15 of the smoke conduit to be scrubbed. Bristles at 16 affixed to the plate periphery extend into proximity of the conduit surface so as to dislodge particles thereon. A rectangular brush plate 14' has components identified with prime reference numerals.

A stationary spider at 17 with legs 18 is carried by the lower end of shaft 11 and serves to rotatably receive the shaft lower end centrally within the smoke conduit. In place on a spider leg 18 is a trigger means including a toggle 20 contactible by the brush plate at its lower limit of travel. A toggle base at 21 is retained in place on the spider leg by set screws 22. A push rod 23, coupled at the lower end to the toggle, is axially displaced upon contact of the brush plate with an arm 20A of the toggle. Shaft 11 carries a thrust ring 19 which supports spider 17 which, in turn, serves to confine shaft 11 against lateral displacement.

A motor control circuit includes a master switch 24 which, upon momentary closure by an operator, initiates motor operation. A sustaining current flow to the motor for motor operation in one direction is through an upper limit switch at 25 having a finger 25A. The motor control circuit further includes a first switch 27 housed at 26 and actuated by a push rod end 23A. Momentary closure of switch 27 by push rod end 23A energizes a relay 28 with the armature at 29 moving to break a first circuit including limit switch 25, line 20, contacts 21–23 and a motor lead 33 with a ground wire at 34. Simultaneously with breaking of the first circuit is the establishment of a branched second circuit including armature closed contacts 35 and 36 and motor lead 37. A relay holding circuit is established for relay 28 by a conductor 38. Accordingly, at the lower limit of brush component travel, toggle trigger 20 is shifted by brush component contact to lift push rod 23 closing switch 27 causing the relay 28 to break the circuit to one set of motor coils and establish a second circuit to the remaining set of motor coils whereupon shaft 11 will be driven in an opposite direction to elevate the non-rotating brush component until the same actuates limit switch 25 to terminate system operation. A light L is on during motor operation. The electrical components are served by an electrical conduit 40.

Driven shaft 11 is preferably of segmented construction to simplify installation within a chimney. Segments of the shaft terminate in inclined surfaces 11B with the segment ends drilled and tapped to receive threaded inserts 11A. Shaft fabrication may include the formation of a single threaded shaft which is subsequently machined into segments by the cutting thereof at intervals along planes inclined in the shaft axis. The groove of the shaft is kept free of deposits by means of a thread chaser at 13A.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

We claim:

1. A chimney cleaning apparatus comprising, a housing, a reversible electric motor within said housing, means for supporting said housing in spaced relationship to the upper end of the chimney, a shaft substantially coextensive with that segment of a chimney to be cleaned, said shaft defining a helical groove, means coupling said shaft to said motor, a brush component including a shaft follower for vertical travel of the brush component during shaft rotation, shaft retainer means for centrally positioning the lower end of said shaft in a chimney, trigger means contactible with said brush component at its lower limit of travel adjacent the lower end of said shaft, a motor control circuit including a first switch actuated by the trigger means and in circuit with a source and said motor to reverse the polarity and the direction of motor operation and hence the direction of shaft rotation and brush component travel, and a second switch actuated by said brush component to break a circuit between said motor and an electrical source.

2. The apparatus claimed in claim 1 wherein said first and second switches are disposed within said housing.

3. The apparatus claimed in claim 2 wherein said brush component is normally at a rest position subjacent said housing and in actuating contact with said second switch.

4. The apparatus claimed in claim 1 wherein said trigger means includes a push rod passing through said brush component and displaced upon the brush component reaching its lower limit of travel.

5. The apparatus claimed in claim 4 wherein said trigger means includes a toggle carried by the shaft retainer means and coupled to the lower end of said push rod.

6. The apparatus claimed in claim 1 wherein said shaft is of segmented construction.

7. The apparatus claimed in claim 6 wherein said shaft comprises multiple segments, cooperating abutting ends of said segments disposed along a plane inclined to the aligned major axes of the shaft segments.

8. The apparatus claimed in claim 7 wherein said housing includes spaced apart housing walls to reduce heat transfer to the housing interior.

9. A chimney cleaning apparatus comprising, a reversible electric motor, means for supporting said motor at one end of a chimney, a screw shaft driven by said motor and adapted for lengthwise placement in a chimney, means confining the shaft against lateral displacement, a brush component adapted to travel along said shaft during shaft rotation to dislodge particles from the chimney interior, means stabilizing the brush component against rotation, and a motor control circuit including switches actuated by the brush component to confine brush travel between points along said shaft.

10. The apparatus claimed in claim 9 wherein said means for supporting said motor is a chimney cap including a motor housing spaced above the chimney outlet.

11. The apparatus claimed in claim 10 wherein said motor control circuit is located in said housing, said stabilizing means embodied in a push rod substantially coterminous with and parallel to said screw shaft, toggle means contactible by said brush component at one extreme of travel and operable to displace said push rod, said push rod, upon being displaced, acting on one of said switches to reverse motor and brush component direction.

12. The apparatus claimed in claim 11 wherein said motor control circuit switches include a limit switch contactible by the brush component to terminate motor operation.

* * * * *